United States Patent [19]

Nelson et al.

[11] Patent Number: 4,998,497

[45] Date of Patent: Mar. 12, 1991

[54] MOORING SYSTEM FOR VESSELS

[75] Inventors: Gregory J. Nelson, Milford; Frederick G. Phelps, Saline, both of Mich.

[73] Assignee: Gregory J. Nelson, Milford, Mich.

[21] Appl. No.: 375,060

[22] Filed: Jun. 30, 1989

[51] Int. Cl.[5] ..... B63B 21/00

[52] U.S. Cl. ..... 114/230; 114/249; 114/343

[58] Field of Search ..... 114/230, 249, 250, 4

[56] References Cited

U.S. PATENT DOCUMENTS

| | | | |
|---|---|---|---|
| 2,078,969 | 5/1937 | Patterson | 52/155 |
| 3,177,839 | 4/1965 | Nolf | 114/230 |
| 3,442,241 | 5/1969 | Daunis | 114/230 |
| 3,546,885 | 9/1968 | Pogonowski | 405/227 |
| 3,628,337 | 12/1971 | Adams et al. | 405/253 |
| 3,793,685 | 2/1974 | Knecht | 114/230 |
| 4,079,690 | 3/1978 | Paul | 114/230 |
| 4,114,556 | 9/1978 | Orndorff et al. | 114/230 |
| 4,129,009 | 12/1978 | Jansz | 405/227 |
| 4,144,831 | 3/1979 | Hyedolph | 114/230 |
| 4,193,368 | 3/1980 | DeGraaf et al. | 114/230 |
| 4,405,262 | 9/1983 | Nagashima | 405/221 |
| 4,468,205 | 8/1984 | Pedersen | 114/230 |
| 4,597,354 | 7/1986 | Gelula | 114/343 |
| 4,625,673 | 12/1986 | Fuller et al. | 114/230 |
| 4,665,856 | 5/1987 | Pedersen | 114/230 |
| 4,697,538 | 10/1987 | Day | 114/230 |
| 4,733,625 | 3/1988 | Allen | 114/230 |
| 4,735,167 | 4/1988 | White et al. | 114/230 |
| 4,771,719 | 9/1988 | Chlebowski | 114/230 |

*Primary Examiner*—David H. Brown

*Attorney, Agent, or Firm*—Peter D. Keefe

[57] ABSTRACT

A watercraft mooring system that is fully resistant against the forces generated by wind and wave action, and its operation is extremely easy and reliable. The invention is composed of four main components: (1) a dock that is selectively releasable from firm anchorage with respect to footings in the lake bottom, (2) a two axes articulation system mounted to the dock, (3) a coupling system that includes a dock-side coupling member that is pivotable and tiltable with respect to the dock via the two axes articulation system and further includes a vessel-side pair of coupling members that interface selectively with the dock-side coupling member to couple the boat to the dock, and, finally, (4) a coupling release mechanism mounted to the vessel for selectively releasing the aforesaid coupling of the boat to the dock. The invention is particularly well suited for use with pontoon boats.

19 Claims, 7 Drawing Sheets

MOORING SYSTEM FOR VESSELS

BACKGROUND OF THE INVENTION

1. Field of the Invention

The present invention relates to mooring systems for boats, particularly to a mooring system which allows for easily releasable coupling of a boat to a dock. The present invention relates still more particularly to such a mooring system for pontoon boats.

2. Description of the Prior Art

Conventional mooring systems for boats generally employ a number of dock pilings to which are tied lines that are, in turn, looped onto cleats located on the aft and bow of the the boat. It is well known that this conventional system of mooring boats results in the vessel having a sideways orientation relative to the dock. When wind or wave action becomes strong, there is the ever present danger of the boat being damaged due to repeated sharp impact with the dock. The effects of the wind and waves on pleasure craft become more pronounced with larger surface area of the vessel on which they may act.

These effects are frequently most pronounced on pontoon boats, whose relatively light structure and large surface area make them particularly vulnerable to dock side impact damage caused by waves and wind. A frequent "solution" by owners of pontoon boats has been to moor their boats in open water so that the pontoon boat is able to relatively freely move in response to wind and wave action without the danger of crashing into a dock. Naturally, this involves the inconvenience of not being able to walk directly to the pontoon boat from dry land.

Accordingly, what is needed is a boat mooring system which prevents the possibility of a boat, particularly a pontoon boat, from impacting the dock in response to wind and wave action.

U.S. Pat. No. 4,144,831 to Hyedolph, dated Mar. 20, 1979, discloses a resilient boat mooring system in which a pair of mooring devices keep the boat away from the dock. Each mooring device is connected with the dock and is spaced from the other. The mooring device is connected to the dock by a coupling rod ending in a ball. The ball fits into a socket of a tubular member having an internal resiliently biased piston. A piston rod connected with the piston terminates in a second socket which connects to a second ball that is integral with a second coupling rod. The second coupling rod is releasably attachable to the boat via a special fitting on the gunwale of the vessel.

U.S. Pat. No. 4,697,538 to Day, dated Oct. 6, 1987, discloses a mooring system which permits rolling, pitching and slight yawing movements of the boat but not movement of the vessel toward the dock. A mooring arm is hingably attached at one end to the dock, having at its opposite end a ball hitch. The ball hitch releasably connects with a ball attached to the gunwale of the boat. A shock absorber is used to control wave effects. The mooring system may use one mooring arm or a pair of them spaced apart.

The prior art devices do not adequately take into account the enormous forces that can be applied to vessels having large surface areas, such as pontoon boats. In this respect, the fixtures are too small and their anchorages not sufficiently substantial, so that they are subject to being bent or ripped from their supports. An additional drawback of the prior art devices is the fact that a considerable amount of effort is required to operate these mooring systems, making them impractical under many circumstances, including situations involving even slight wave or wind action.

Accordingly, there yet remains a need to devise a watercraft mooring system which can accommodate large surface area boats, such as pontoon boats, against the enormous forces generated by wind and wave action, as well as a simple, reliable connection and release system that recommends its use in a wide range of applications.

SUMMARY OF THE INVENTION

The present invention is a watercraft mooring system that is fully resistant against the forces generated by wind and wave action, and its operation is extremely easy and reliable.

The present invention is composed of four main components: (1) a dock that is selectively releasable from firm anchorage with respect to footings in the lake bottom, (2) a two axes articulation system mounted to the dock, (3) a coupling system that includes a dock-side coupling member that is pivotable and tiltable with respect to the dock via the two axes articulation system and further includes a vessel-side pair of coupling members that interface selectively with the dock-side coupling member to couple the boat to the dock, and, finally, (4) a coupling release mechanism mounted to the vessel for selectively releasing the aforesaid coupling of the boat to the dock.

The dock is composed generally of a frame which is releasably held firm to the lake bottom by a plurality of turnbuckled guy wires that are connected with footings in the lake bottom.

The two axes articulation system has a tilting cylinder that tiltably mounts at one end to a cylindrical mounting on the dock and has at its other end a cylindrical pivot mounting.

The dock-side coupling member is constructed of a flat frame having at one end a pivoting cylinder that pivotally mounts to the cylindrical pivot mounting of the two axes articulation system. The other end of the flat frame has a cylindrical coupling interface member. The vessel-side pair of coupling members is composed of two spaced apart connectors which are attached to the boat, and which selectively engagingly couple with the cylindrical coupling interface member.

The coupling release mechanism is mounted to the vessel and is structured to selectively release the aforesaid coupling between the pair of coupling members and the cylindrical coupling interface member.

Accordingly, it is an object of the present invention to provide a mooring system for watercraft, particularly pontoon boats, that simply and easily moors the boat, yet keeps the boat separated at all times from the dock.

It is an additional object of the present invention to provide a mooring system for boats that keeps the boat a safe distance from the dock and yet is able to withstand the enormous forces generated by wind and wave action, even with respect to large surface area vessels, such as pontoon boats.

It is another object of the present invention to provide a mooring system for watercraft which keeps the vessel safely spaced from the dock, yet permits the boat to rock and move up and down in response to wave and wind action.

It is still an additional object of the present invention to provide a mooring system for boats that keeps the vessel separated from the dock, where the coupling system is easily operated in that: (a) the mooring system includes a coupling system that automatically aligns itself for coupling when the skipper maneuvers the vessel-side pair of coupling members into proximity with the dock-side coupling member, and (b) the skipper may actuate release of the coupling system remotely while on his or her boat.

It is yet a further object of the present invention to provide a mooring system for boats in which the dock is selectively releasable from footings located in the lake bottom.

It is still an additional object of the present invention to provide a mooring system for boats in which the dock has connected thereto a coupling mechanism that may relatively pivot and tilt, the pivoting and tilting movement being resiliently biased to a predetermined orientation.

It is yet a further object of the present invention to provide a mooring system for a vessel that incorporates a locking mechanism to prevent unauthorized use of the vessel.

These, and additional objects, advantages, features and benefits of the present invention will become apparent from the following specification.

DETAILED DESCRIPTION OF THE PREFERRED EMBODIMENT

Figure 1:
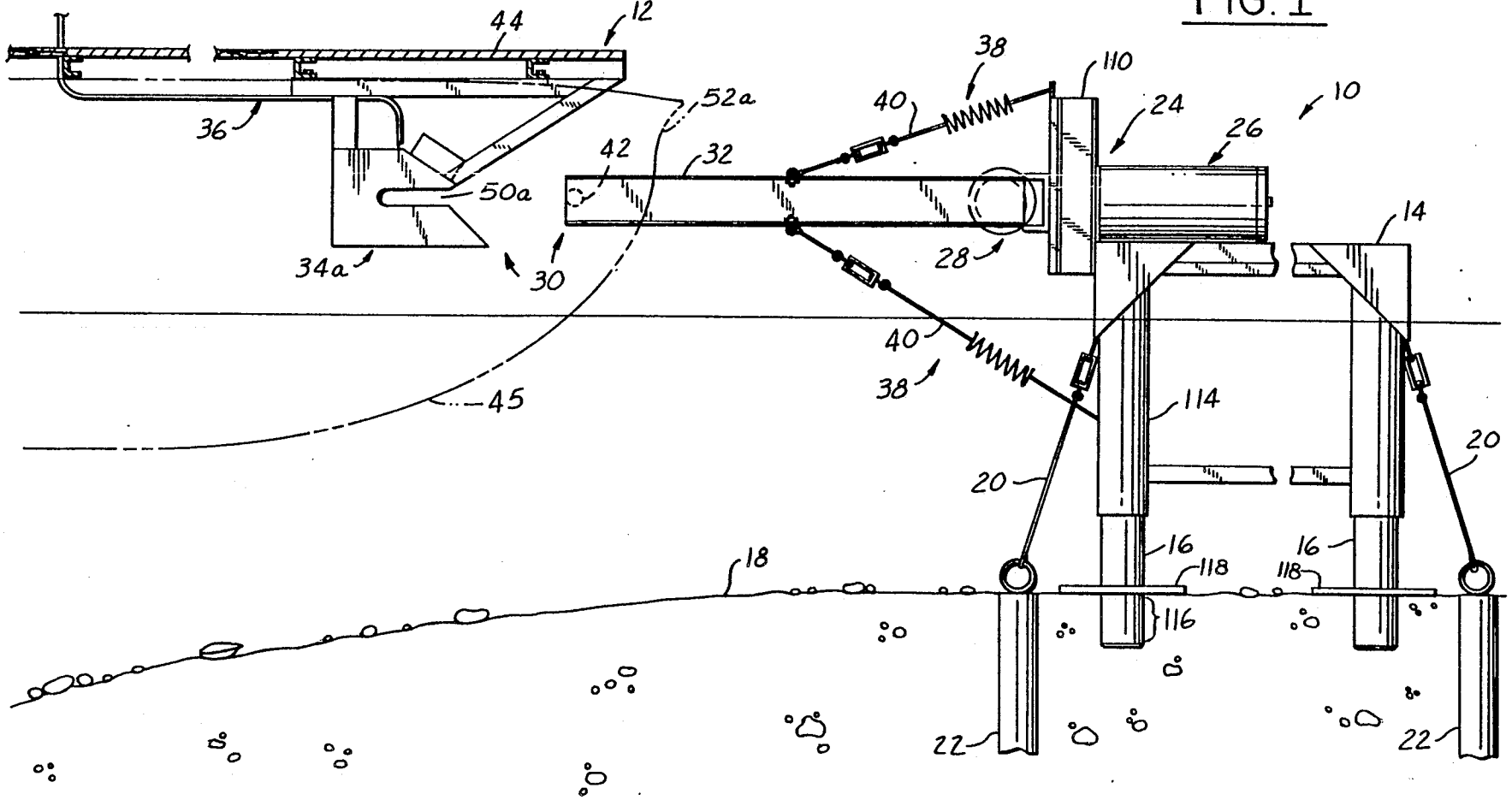
FIG. 1 is a part sectional side view of the mooring system according to the present invention in operation with a pontoon boat.

Referring now to the Drawing, FIG. 1 shows the mooring system 10 according to the present invention in operation in conjunction with a pontoon boat 12. It will be seen from FIG. 1 that the mooring system 10 is composed of four main components: (1) a dock 14 having footings 16 for resting on the lake bottom 18, the dock being selectively anchored to the lake bottom 18 by cables 20 which are connected with pilings 22 set into the lake bottom, (2) a two axes articulation system 24 mounted to the dock 14, including a tilting portion 26 and a pivoting portion 28, (3) a coupling system 30 that includes a dock-side coupling member 32 which is pivotable and tiltable with respect to the dock 14 via the two axes articulation system 24 and further includes a vessel-side pair of coupling members **34*a* and 34*b* that interface selectively with the dock-side coupling member 32 so as to couple the boat 12 to the dock 14, and, finally, (4) a coupling release mechanism 36 mounted to the vessel for selectively releasing the aforesaid coupling of the boat to the dock. Further, there will be seen in FIG. 1 a dock-side coupling member biasing system 38 in which a plurality of resilient cables 40 retain the dock-side coupling member 32** in a predetermined orientation, which ordinarily is preferred to be in the plane of the water surface, which, of course, also may be defined as the horizontal.

Docking of the boat 12 is accomplished by selectively engagingly coupling the vessel-side pair of coupling members **34*a* and 34*b* with a preferably cylindrically shaped coupling interface member 42 connected with the dock-side coupling member 32**, as will be described in detail hereinbelow.

Figure 3:
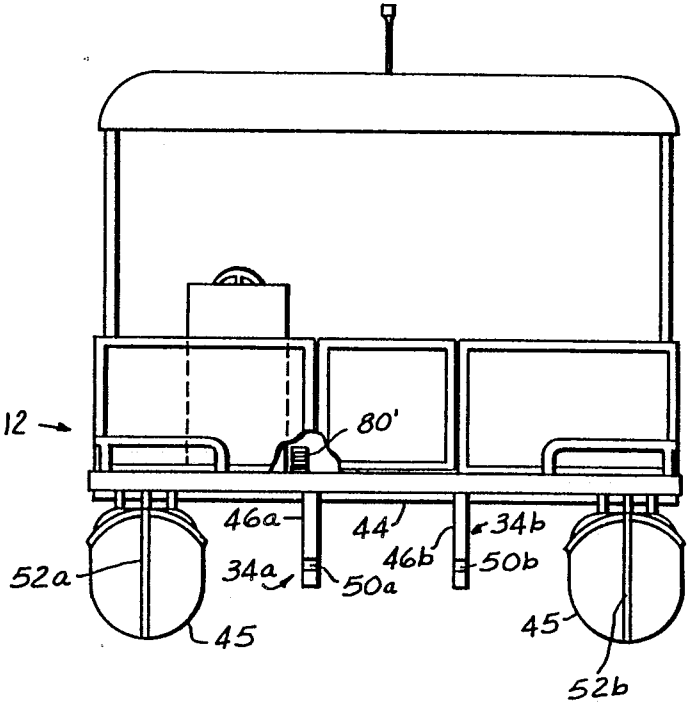
FIG. 3 is a front view of the pontoon boat of FIG. 2, seen along line 2 in FIG. 2.
Figure 2:
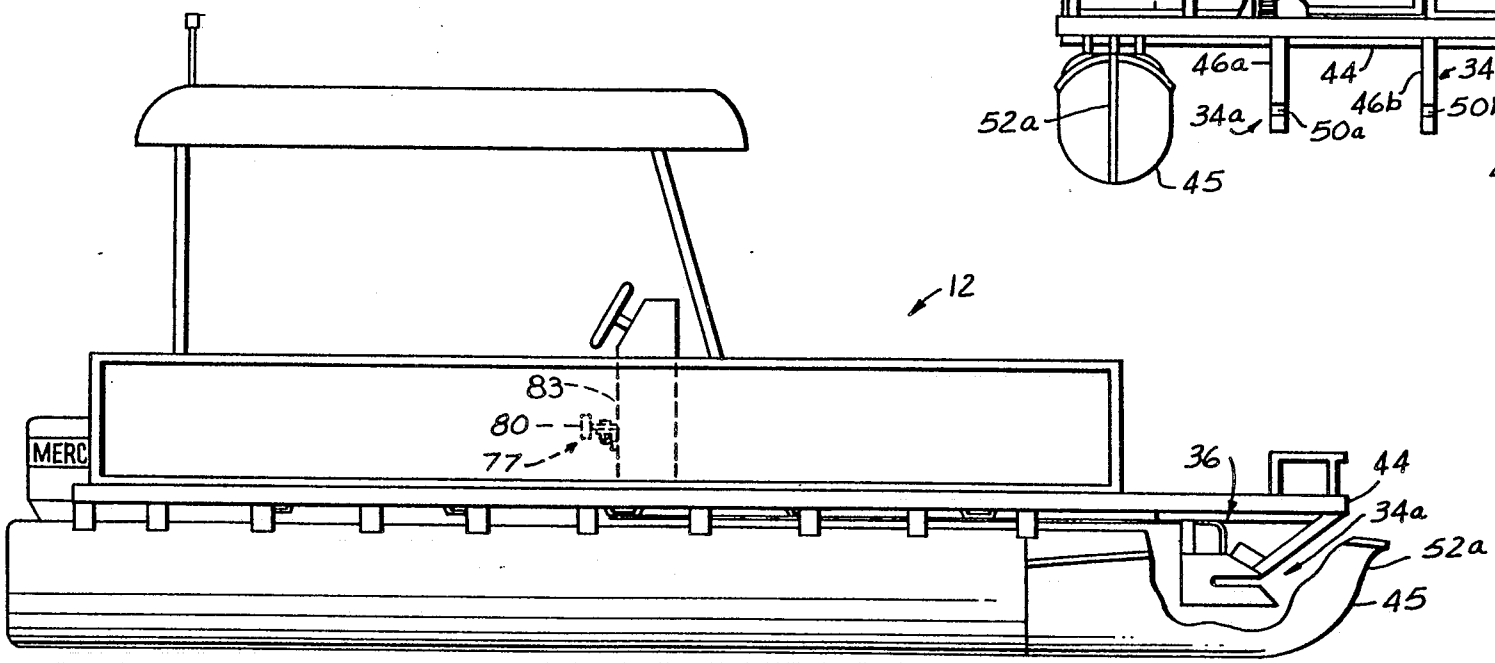
FIG. 2 is a part broken-away side view of a pontoon boat equipped for use with the mooring system according to the present invention.

Referring now to FIGS. 2 and 3, the preferred location of the vessel-side pair of coupling members **34*a* and 34*b* will be discerned. When installed on a conventional pontoon boat 12, the vessel-side pair of coupling members are located under the floor 44 of the boat 12, spaced mutually apart between the pontoons 45** in the orientation as shown.

Figure 4:
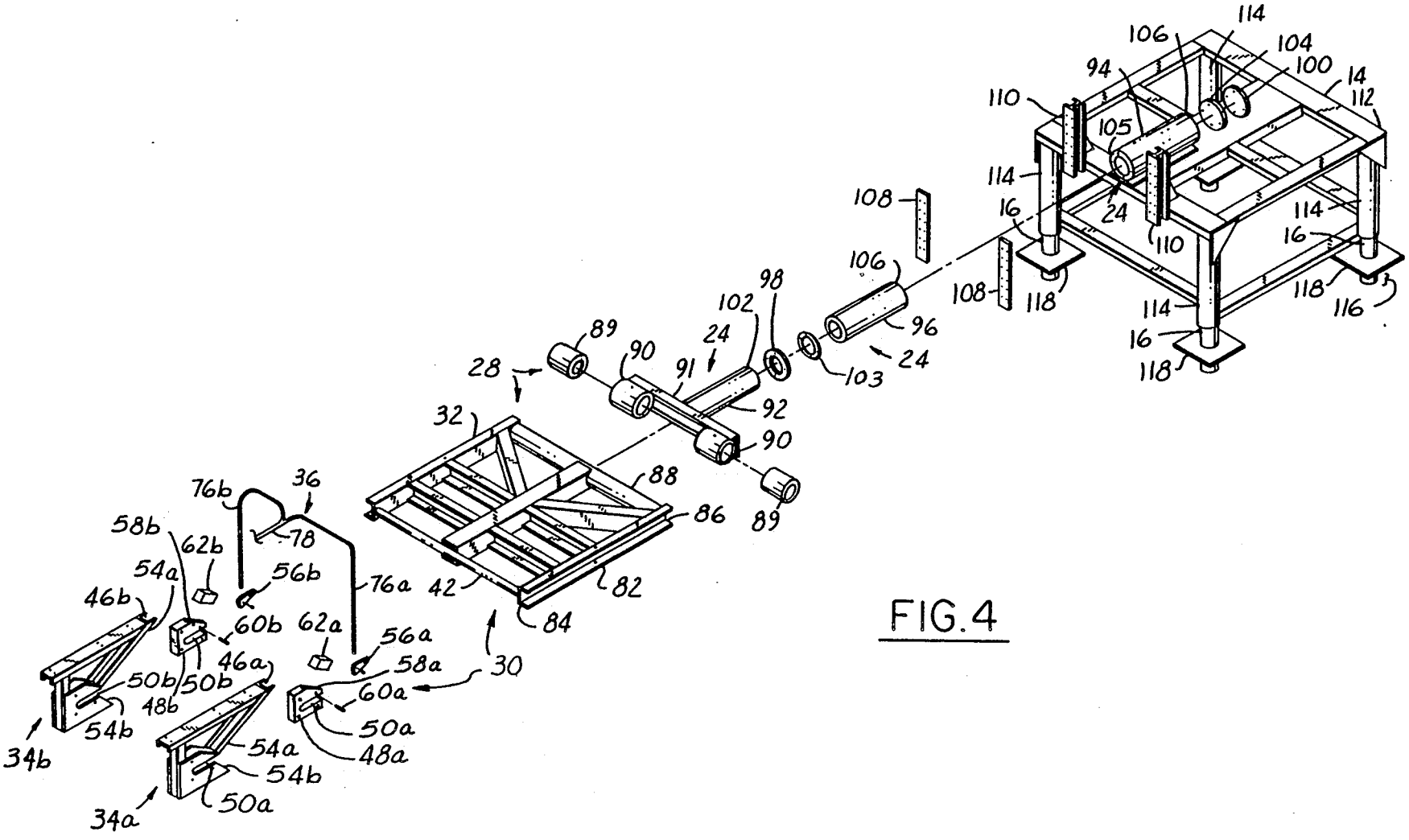
FIG. 4 is an exploded perspective view showing the mooring system according to the present invention, less the biasing means for the dock-side coupling member and less the dock anchorage means, each of which being shown particularly in FIG. 8.
Figure 5:
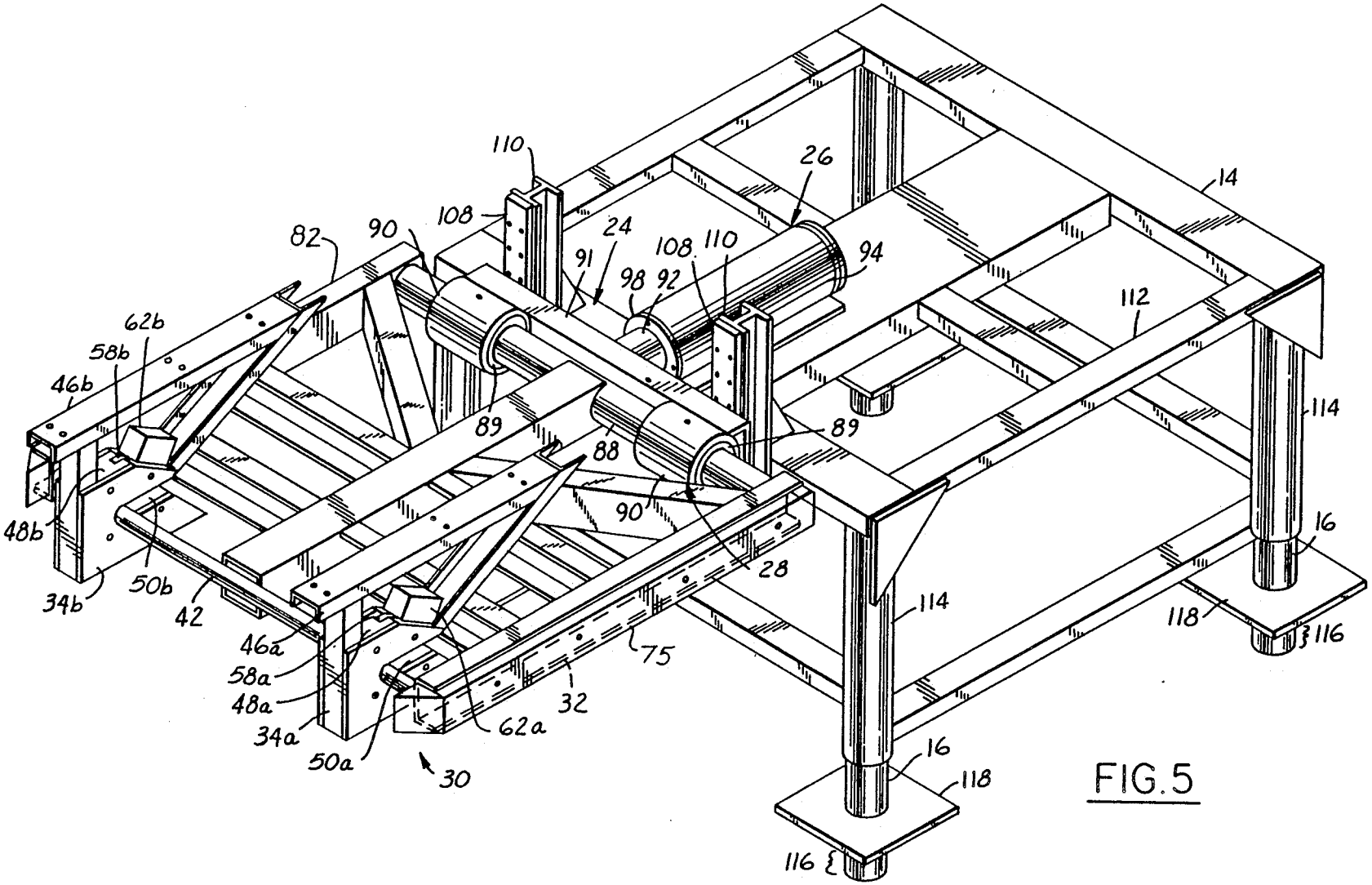
FIG. 5 is a perspective view of the mooring system shown in FIG. 4, now showing the components coupled together.

The components of the mooring system 10 will now be discussed with particular reference to FIGS. 4 and 5 which show perspective views of the invention, as well as other figures, as noted. Firstly, the vessel-side components will be described.

Figure 6:
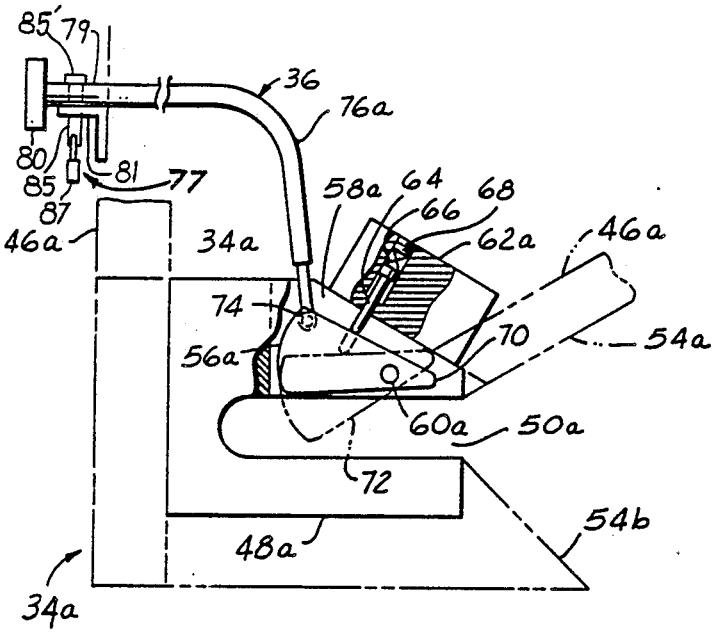
FIG. 6 is a detail part sectional side view of one of the vessel-side pair of coupling members and the coupling release mechanism.

Referring now also to FIG. 6, the vessel-side pair of coupling members **34*a* and 34*b* are bolted to the boat 12 in the location discussed above via a mounting structure 46*a* and 46*b*, respectively. Each coupling member of the vessel-side pair of coupling members includes an internal coupling block 48*a* and 48*b*, respectively, which is bolted to its respective coupling member 34*a* or 34*b*. Each of the coupling blocks and the vessel-side pair of coupling members have a slot 50*a* and 50*b*, respectively, which faces in a direction away from the boat 12. In FIGS. 1 and 3, this direction is pointed in the same direction as the bow tips 52*a* and 52*b* of the pontoons 45. The slots 50*a* and 50*b* are dimensioned to receive the coupling interface member 42. It will be seen from FIG. 4, that on either side of each slot are present obtusely angled portions, one obtusely angled portion 54*a* formed by the mounting structure above each slot and a second obtusely angled portion 54*b*** formed by the coupling member below each slot. These obtusely angled portions assist alignment of the coupling interface member with the slots, as will be discussed more fully when discussing the operation of the invention.

When the coupling interface member 42 seats within the slots 50*a* and 50*b*, coupling engagement is achieved by a pivotable detent 56*a* and 56*b* located, respectively in a cut-out 58*a* and 58*b* in each of the coupling blocks 48*a* and 48*b*. The detents pivot on a pin 60*a* and 60*b*, respectively, in each of the coupling blocks. A detent biasing mechanism 62*a* and 62*b* is, respectively, located on each coupling block above its adjacent cut-out. As can best be seen from FIG. 6, each of the detent biasing mechanisms normally biases its adjacent detent into its respective slot by action of a bias rod 64 acted on by a spring 66 that has an adjustable spring constant regulated by a set-screw 68. Because each detent has a generally triangular shape having an acute corner 70 and because the pivot pin passes through its respective detent adjacent the acute corner thereof, the coupling interface member 42 may slide relative to the detent along the leading side 72 thereof that is normally biased into the slot, thereby pushing the detent up into its respective cut-out 58*a* or 58*b*, until the coupling interface member has passed far enough into the slot to allow the detent to bias back into the slot, resulting in the coupling interface member 42 being trapped in each slot 52*a* and 52*b*. It is understood that the present invention is not to be limited to this specific structure for the coupling system 30, as this recited structure is by way of preferred example only.

Figure 7:
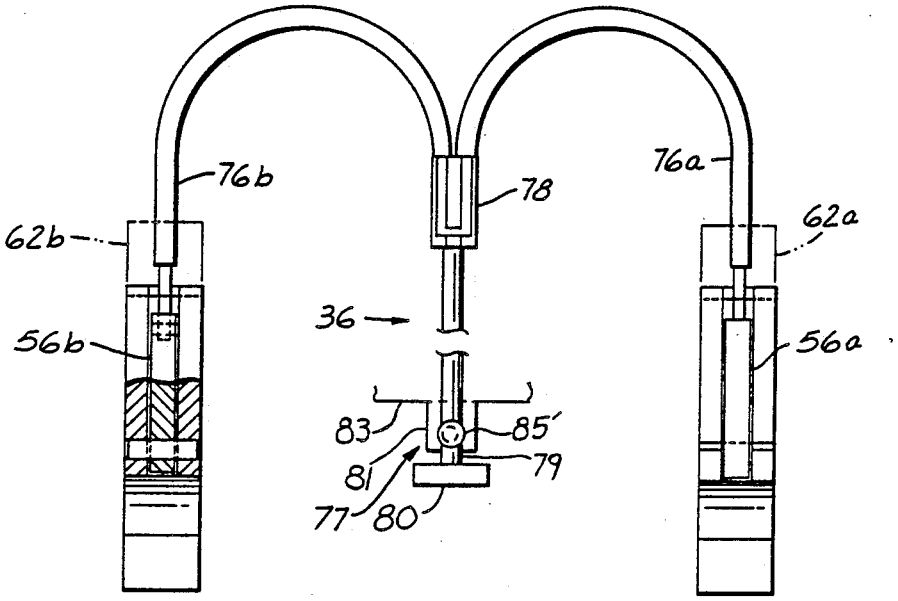
FIG. 7 is a part sectional plan view of the coupling release system of the mooring system according to the present invention.

Referring now also to FIGS. 6 and 7, the coupling release mechanism 36 for selective release of the coupling interface member 42 from the vessel-side pair of coupling members 34*a* and 34*b* may be understood. At a second corner 74 of each detent 56*a* and 56*b*, second corner 74 being located interior to its respective cut-out 58*a* or 58*b*, a release cable 76*a* or 76*b* is, respectively, connected thereto. Each release cable combines into a conventional type cable release mechanism 78 connected to the boat 12 and actuated by pulling on a handle 80, or, alternatively, by depressing a foot pedal 80' either of which being located conveniently near the control systems for the vessel, as indicated in FIGS. 2 and 3. When the handle is pulled or the foot pedal is depressed, each of the detents are caused to retract fully into their respective cut-outs, thereby allowing the coupling interface member to disengage the vessel-side pair of coupling members 34*a* and 34*b*.

As a facility to prevent unauthorized usage of the vessel, a lock mechanism 77 is provided. An example of such a lock mechanism is shown in FIGS. 2, 6 and 7 in conjunction with the handle 80. The handle 80 has a shaft 79 that is slidable relative to a shoulder 81 connected with the instrument console 83 of the vessel 12. A bore is provided in each of the shaft and the shoulder, and the bores align when the handle is in its normally spring biased non-actuated position shown in FIG. 6. A pin 85 is selectively inserted into the bores, and the pin is provided with a hole at the end opposite its head 85'. A conventional lock 87 may be inserted through the hole in the pin 85 so as to prevent pulling out of the handle, and, consequently, unauthorized release of the vessel 12 from the dock 14.

Figure 8:
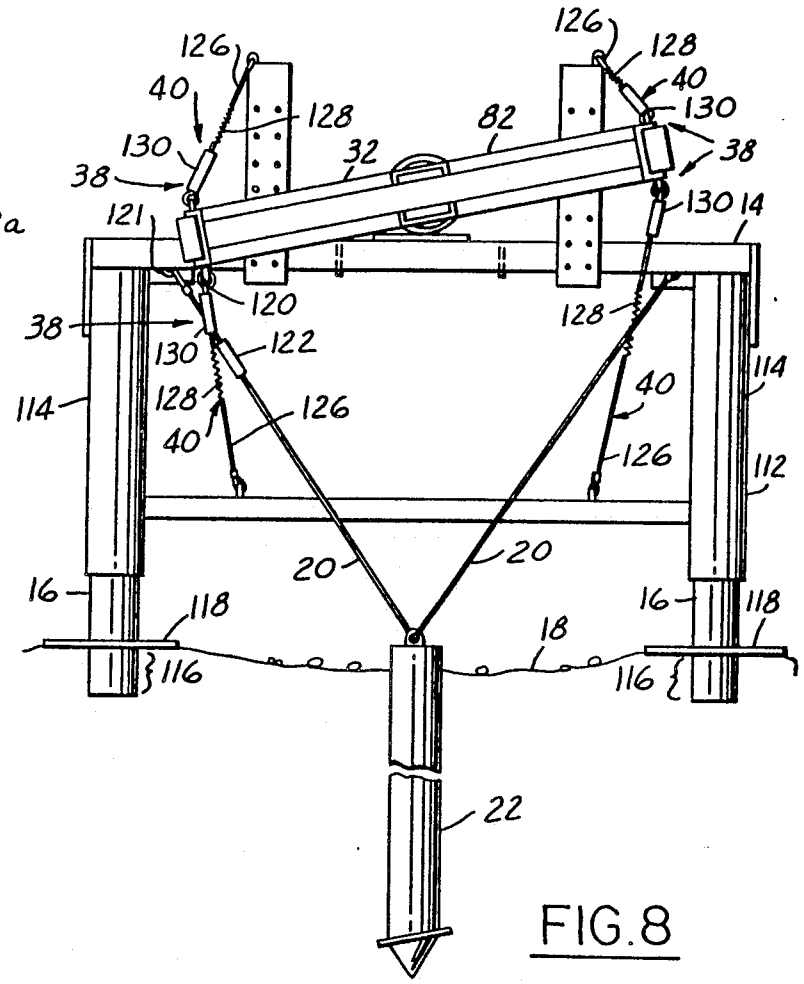
FIG. 8 is a front view of the dock-side coupling member, showing particularly the means for anchoring the dock and means for biasing the dock-side coupling member with respect to the horizontal.
Figure 9:
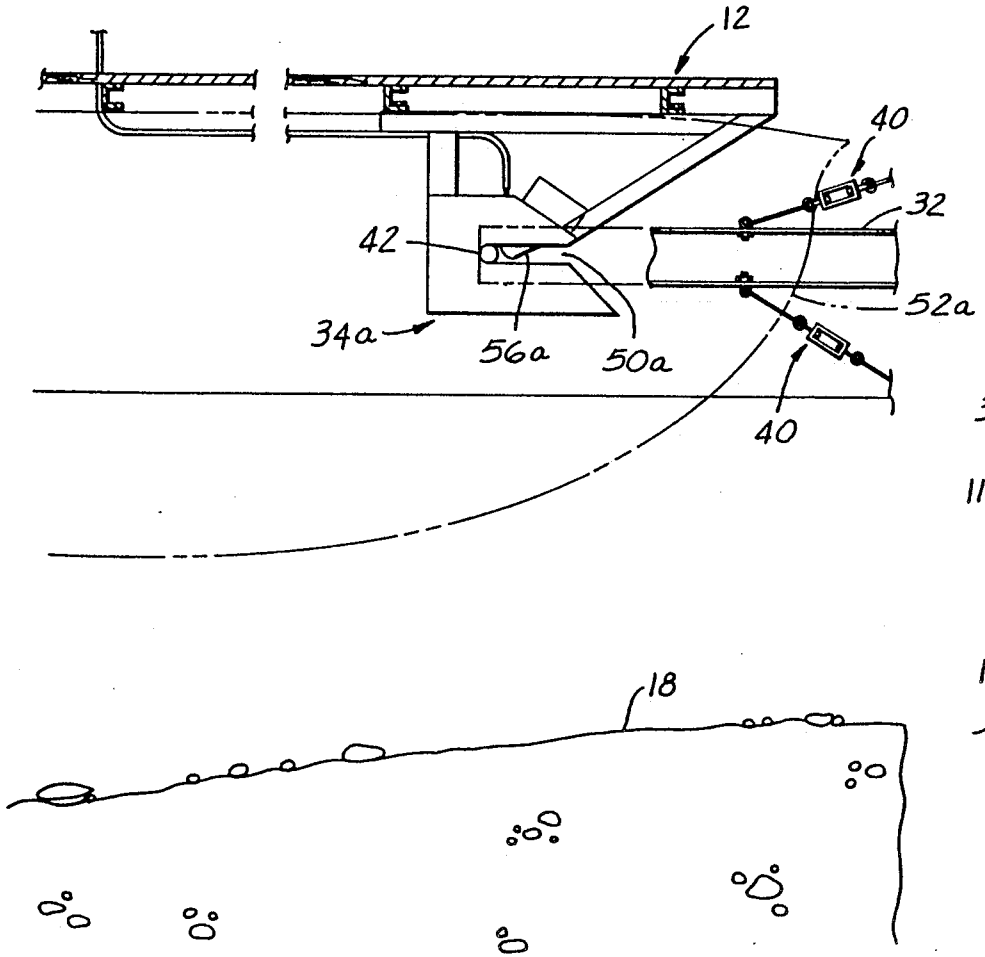
FIG. 9 is a truncated part sectional side view of the mooring system according to the present invention in operation, in which the pontoon boat is moored.
Figure 10:
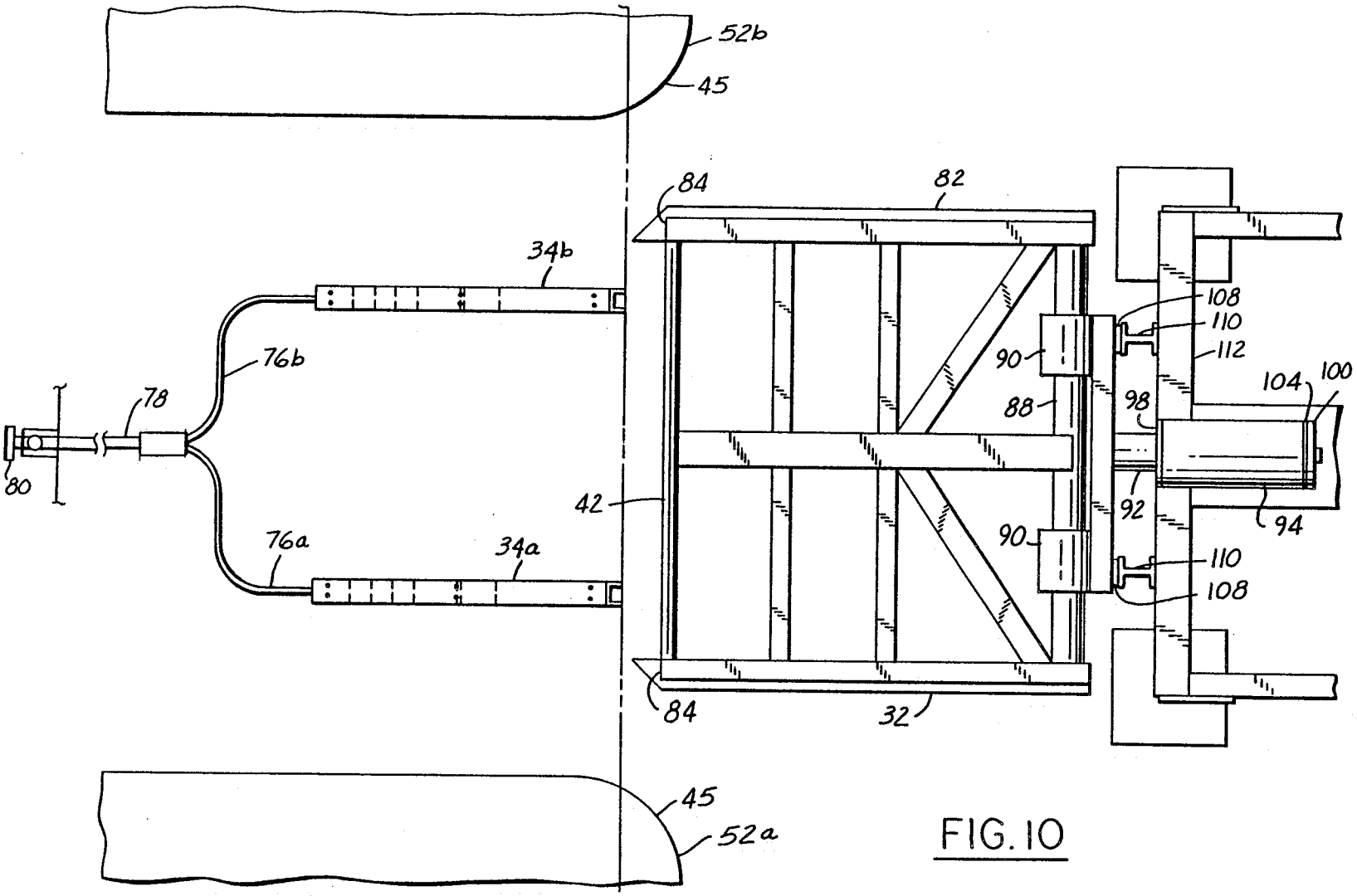
FIG. 10 is a truncated plan view of the mooring system according to the present invention in operation, showing a portion of the pontoon boat, the vessel-side pair of coupling members, the dock-side coupling member, the two axes articulation system, and part of the dock.

Referring now to FIGS. 8 through 10, in addition to FIGS. 4 and 5, the dock-side components will be described.

The dock-side coupling member 32 is composed of an engagement frame 82 having connected thereto at its forward end 84 the aforementioned coupling interface member 42. The rear end 86 of the engagement frame 82 has attached a pivoting cylinder 88 which is in parallel alignment with the coupling interface member 42. A bumper 75 is provided on either side of the engagement frame 82; the bumper is preferred to be constructed of high impact plastic and is intended to harmlessly receive accidental vessel collisions during docking maneuvers.

The pivoting portion 28 of the two axes articulation system 24 includes a pair of cylindrical pivot mounting fittings 90, connected by a cross member 91, for rotatably connecting within the pivoting cylinder 88. A bearing sleeve 89, preferably made of a low friction polymer such as DELRIN, is located between the pivoting cylinder and each of the cylindrical pivot mounting fittings to facilitate rotative movement therebetween.

The tilting portion 26 of the two axes articulation system 24 includes a tilting cylinder 92 which is perpendicularly mounted to the pair of cylindrical pivot mounting fittings 90 and oriented in a plane defined by the engagement frame 82. The tilting cylinder 92 is structured to rotatably connect within a cylindrical tilt mounting fitting 94 that is connected with the dock 14. A bearing sleeve 96, also preferably made of DELRIN, is located between the tilting cylinder and the cylindrical tilt mounting fitting. The tilting cylinder 92 is fastened with respect to the cylindrical tilt mounting fitting 94 by: (1) a thrust washer 98 which is welded to the tilt cylinder and interferingly engages the forward end 105 of the tilt mounting fitting 94, a thrust bearing 103, preferably made of DELRIN being located therebetween; and, (2) an end cap 100 which is bolted to the rear end 102 of the cylindrical tilting cylinder 92 so that the outer periphery of the end cap interferingly engages the rear end 106 of the tilt mounting fitting 94. A bearing plate 104, also preferably made of DELRIN, is located between the end cap 100 and the rear end 106 of the tilt mounting fitting 94 to minimize friction during tilting of the dock-side coupling member. The thrust washer 98 and the end cap 100 combine to ensure that the tilt cylinder will not axially move in the cylindrical tilt mounting fixture. In addition, bearing pads 108, also preferably made of DELRIN, are mounted to supports 110 connected with the dock 12 so as to slidably contact the cross member 91 so as to keep the two axes articulation system aligned with the dock even in high seas on the order of four feet.

The dock 14 is constructed of a generally box frame 112 including four legs 114. The lowermost portion of each of the legs terminates in a footing 16 that rests in the lake bottom 18 and projects a small anchoring distance 116 thereinto. The anchoring distance is determined by a lake bottom plate 118 which has a large surface area and is intended to rest on the lake bottom surface.

As can be seen in FIGS. 1 and 8, the dock is releasably anchored onto the lake bottom 18 by operation of a plurality of cables 20 that are secured to pilings 22 sunk deeply into the lake bottom 18. Each cable 20 is connected with the dock, with one end of the cable ending in a releasable buckle 120 that fits into an eyelet 121 on the dock frame 114. Each cable further includes a turnbuckle 122 for tightening the cable 20 with respect to the piling 22 that it loops through. This preferred construction facilitates dock removal in the fall and replacement in the spring.

As can be further discerned from FIGS. 1 and 8, the dock-side coupling member biasing system 38 connected between the dock frame 114 and the engagement frame 82 effects to bias the coupling member 32 so that it normally assumes a horizontal orientation by operation of a plurality of resilient cables 40, each resilient cable including a cable portion 126, a resilient portion 128, such as rubber, and a turnbuckle 130. The turnbuckle permits adjustment of the biasing force of the dock-side coupling member biasing system 38. Four resilient cables are preferred, two on each side of the engagement frame, two being located below the engagement frame and the other two being located above the engagement frame, as shown in FIG. 8.

In operation, the skipper would maneuver his or her vessel so that the vessel-side pair of coupling members come into adjacency with the dock-side coupling member. The vessel is then maneuvered so that the coupling interface member slides into the slots in the pair of coupling members sufficient for the detents to be released into the slots. The obtuse portions of the vessel-side pair of coupling members located above and below the slots aid alignment during this process. The vessel is thereupon docked. When it is desired to cast-off, the skipper unlocks the cable release handle then pulls on it (or depresses the foot pedal) causing the detents to be retracted, thereby freeing the coupling interface member from the slots in the pair of coupling members. The skipper then just backs-off away from the dock to commence his or her nautical adventure.

To those skilled in the art to which this invention appertains, the above described preferred embodiment may be subject to change or modification. For instance, while the preferred embodiment relates to operation with a pontoon boat, other types of vessels may be readily adapted by those having ordinary skill in the art for use with the present invention. Such change or modification can be carried out without departing from the scope of the invention, which is intended to be limited only by the scope of the appended claims.

What is claimed is:

1. A mooring system for a vessel, said mooring system being connected with a dock, said mooring system, comprising:

a dock-side coupling member having a first end and a second end;

an engagement interface member connected to said first end of said dock-side coupling member;

two axes articulation means connected with said dock and said second end of said dock-side coupling member for permitting said dock-side coupling member to pivot and tilt with respect to said dock;

vessel-side coupling means connected with said vessel for selectively coupling with respect to said coupling interface means so as to couple said vessel to said dock, said vessel-side coupling means being structured so as to automatically engage with said coupling interface means; and coupling release means for selectively releasing said coupling between said engagement interface member and said vessel-side coupling means said vessel-side coupling means comprises:

at least two mutually spaced apart coupling members connected with said vessel, each said coupling member having a slot for receiving said engagement interface member; and detent means connected with each said coupling member and with said coupling release means for preventing said engagement interface member from exiting said slot of each said coupling member after said engagement interface member has been received therein unless said coupling release means is actuated; said detent means comprising:

a coupling block connected with a respective said coupling member, said coupling block having a cut-out communicating with said slot of said respective coupling member;

a detent located in said cut-out of said coupling block, said detent being pivotally connected with said coupling block such that at least a portion of said detent may be pivoted into and out of said slot of said respective coupling member; and biasing means connected with said coupling block for supplying a biasing force on said detent so that at least a portion of said detent is in said slot of said respective coupling member.

2. The mooring system for a vessel of claim 1, wherein said coupling release means comprises:

a release cable connected with each said detent;

cable release mechanism means connected with each said release cable for inter connecting each said release cable; and release means connected with said cable release mechanism for selective actuation by a user so as to overcome said biasing force on each said detent, thereby causing each said detent to pivot out of its respective said slot of said respective coupling member and thereby allow said engagement interface member to exit said slot of each said coupling member.

3. The mooring system for a vessel of claim 2, further comprising lock means for selectively locking said release means of said coupling release means so as to thereby selectively prevent actuation thereof by a user.

4. The mooring system for a vessel of claim 1, further comprising dock-side coupling member biasing means connected with said dock and said dock-side coupling member for biasing said dock-side coupling member to a predetermined orientation relative to said dock.

5. The mooring system for a vessel of claim 4, wherein said dock-side coupling member biasing means comprises a plurality of resilient cables connected between said dock and said dock-side coupling member, each said resilient cable supplying a biasing force on said dock-side coupling member so as to bias said dock-side coupling member to said predetermined orientation, each said resilient cable comprising:

a cable portion;

a resilient portion connected with said cable portion; and turnbuckle means connected with one of said cable portion and said resilient portion for selectively adjusting said biasing force.

6. The mooring system for a vessel of claim 1, wherein said two axes articulation means comprises:

a pivoting cylinder connected with said second end of said dock-side coupling member, said pivoting cylinder being oriented in parallel relationship with respect to said engagement interface member;

at least one cylindrical pivot mounting fitting which pivotally receives said pivoting cylinder;

a tilting cylinder connected with said at least one cylindrical pivot mounting fitting, said tilting cylinder being perpendicularly oriented with respect to said at least one cylindrical pivot mounting fitting;

a cylindrical tilt mounting fitting connected with said dock, said cylindrical tilt mounting fitting tiltably receiving said tilting cylinder;

thrust washer means connected with said tilting cylinder for aiding retention of said tilting cylinder in a received relationship with respect to said cylindrical tilt mounting fitting; and end cap means connected with said tilting cylinder for further aiding retention of said tilting cylinder in a received relationship with respect to said cylindrical tilt mounting fitting.

7. The mooring system for a vessel of claim 6, wherein said two axes articulation system further comprises:

first bearing means located between said pivoting cylinder and said at least one cylindrical pivot mounting fitting for reducing friction therebetween;

second bearing means located between said tilting cylinder and said cylindrical tilt mounting fitting for reducing friction therebetween;

a cross member connected with said at least one cylindrical pivot mounting fitting;

a pair of supports connected with said dock, one support on each side of said cylindrical tilt mounting fitting; and third bearing means on said pair of supports for reducing friction between said cross member and said pair of supports.

8. A mooring system for a vessel, said mooring system comprising:

a dock for mooring vessels, said dock being locatable on a body of water bottom, said dock comprising:

a frame;

a plurality of legs connected with said frame;

a footing connected with each leg of said plurality of legs, each said footing having plate means connected with each said leg for providing a surface resistant to sinking into said body of water bottom; and connection means for releasably connecting said frame to said body of water bottom;

a dock-side coupling member having a first end and a second end;

coupling interface means connected to said first end of said dock-side coupling member for selectively coupling said dock to said vessel;

two axes articulation means connected with said dock and said second end of said dock-side coupling member for permitting said dock-side coupling member to pivot and tilt with respect to said dock;

vessel-side coupling means connected with said vessel for selectively coupling with respect to said coupling interface means so as to couple said vessel to said dock; and coupling release means for selectively releasing said coupling between said coupling interface means and said vessel-side coupling means. coupling member biasing means comprises a plurality of resilient cables connected between said dock and said dock-side coupling member, each said resilient cable supplying a biasing force on said dock-side coupling member so as to bias said dock-side coupling member to said predetermined orientation, each said resilient cable comprising:

a cable portion;

a resilient portion connected with said cable portion; and turnbuckle means connected with one of said cable portion and said resilient portion for selectively adjusting said biasing force.

9. The mooring system for a vessel of claim 8, wherein said two axes articulation means comprises:

a pivoting cylinder connected with said second end of said dock-side coupling member, said pivoting cylinder being oriented in parallel relationship with respect to said engagement interface member;

at least one cylindrical pivot mounting fitting which pivotally receives said pivoting cylinder;

a tilting cylinder connected with said at least one cylindrical pivot mounting fitting, said tilting cylinder being perpendicularly oriented with respect to said at least one cylindrical pivot mounting fitting;

a cylindrical tilt mounting fitting connected with said dock, said cylindrical tilt mounting fitting tiltably receiving said tilting cylinder;

thrust washer means connected with said tilting cylinder for aiding retention of said tilting cylinder in a received relationship with respect to said cylindrical tilt mounting fitting; and end cap means connected with said tilting cylinder for further aiding retention of said tilting cylinder in a received relationship with respect to said cylindrical tilt mounting fitting.

10. The mooring system for a vessel of claim 9, wherein said two axes articulation system further comprises:

first bearing means located between said pivoting cylinder and said at least one cylindrical pivot mounting fitting for reducing friction therebetween;

second bearing means located between said tilting cylinder and said cylindrical tilt mounting fitting for reducing friction therebetween;

a cross member connected with said at least one cylindrical pivot mounting fitting;

a pair of supports connected with said dock, one support on each side of said cylindrical tilt mounting fitting; and third bearing means on said pair of supports for reducing friction between said cross member and said pair of supports.

11. The mooring system for a vessel of claim 10, wherein said connection means comprises:

at least two pilings driven into said body of water bottom, one piling being located on either side of said frame;

at least one connection cable connected with each of said piling and said frame;

releasable connection means connected with each said connection cable for releasably connecting said connection cable to said frame; and turnbuckle means connected with said connection cable for permitting selective tightening of said connection cable with respect to its respective said piling and said frame.

12. The mooring system for a vessel of claim 8, wherein said coupling interface means comprises an engagement interface member connected to said first end of said dock-side coupling member; further wherein said vessel-side coupling means comprises:

at least two mutually spaced apart coupling members connected with said vessel, each said coupling member having a slot for receiving said engagement interface member; and detent means connected with each said coupling member and with said coupling release means for preventing said engagement interface member from exiting said slot of each said coupling member after said engagement interface member has been received therein unless said coupling release means is actuated.

13. The mooring system for a vessel of claim 12, further comprising dock-side coupling member biasing means connected with said dock and said dock-side coupling member for biasing said dock-side coupling member to a predetermined orientation relative to said dock.

14. The mooring system for a vessel of claim 13, wherein said dock-side coupling member biasing means comprises a plurality of resilient cables connected between said dock and said dock-side coupling member, each said resilient cable supplying a biasing force on said dock-side coupling member so as to bias said dock-side coupling member to said predetermined orientation, each said resilient cable comprising:

a cable portion;

a resilient portion connected with said cable portion; and turnbuckle means connected with one of said cable portion and said resilient portion for selectively adjusting said biasing force.

15. The mooring system for a vessel of claim 14, wherein said connection means comprises:

at least two pilings driven into said body of water bottom, one piling being located on either side of said frame;

at least one connection cable connected with each of said piling and said frame;

releasable connection means connected with each said connection cable for releasably connecting said connection cable to said frame; and turnbuckle means connected with said connection cable for permitting selective tightening of said connection cable with respect to its respective said piling and said frame.

16. The mooring system for a vessel of claim 12, wherein said detent means comprises:

a coupling block connected with a respective said coupling member, said coupling block having a cut-out communicating with said slot of said respective coupling member;

a detent located in said cut-out of said coupling block, said detent being pivotally connected with said coupling block such that at least a portion of said detent may be pivoted into and out of said slot of said respective coupling member; and biasing means connected with said coupling block for supplying a biasing force on said detent so that at least a portion of said detent is in said slot of said respective coupling member.

17. The mooring system for a vessel of claim 16, wherein said coupling release means comprises:

a release cable connected with each said detent;

cable release mechanism means connected with each said release cable for interconnecting each said release cable; and release means connected with said cable release mechanism for selective actuation by a user so as to overcome said biasing force on each said detent, thereby causing each said detent to pivot out of its respective said slot of said respective coupling member and thereby allow said engagement interface member to exit said slot of each said coupling member.

18. The mooring system for a vessel of claim 17, further comprising lock means for selectively locking said release means of said coupling release means so as to thereby selectively prevent actuation thereof by a user.

19. The mooring system for a vessel of claim 18, wherein said connection means comprises:

at least two pilings driven into said body of water bottom, one piling being located on either side of said frame;

at least one connection cable connected with each of said piling and said frame;

releasable connection means connected with each said connection cable for releasably connecting said connection cable to said frame; and turnbuckle means connected with said connection cable for permitting selective tightening of said connection cable with respect to its respective said piling and said frame.

* * * * *